US006296353B1

(12) United States Patent
Thielman et al.

(10) Patent No.: US 6,296,353 B1
(45) Date of Patent: Oct. 2, 2001

(54) INK CONTAINER WITH SECONDARY CONTAINMENT FOR INK SUPPLY

(75) Inventors: Jeffrey L. Thielman, Corvallis; Rhonda L. Wilson, Monmouth, both of OR (US)

(73) Assignee: Hewlett-Packard Company, Palo Alto, CA (US)

( * ) Notice: Subject to any disclaimer, the term of this patent is extended or adjusted under 35 U.S.C. 154(b) by 0 days.

(21) Appl. No.: 09/562,991

(22) Filed: May 1, 2000

Related U.S. Application Data

(63) Continuation of application No. 09/437,769, filed on Nov. 9, 1999, which is a continuation of application No. 08/868,927, filed on Jun. 4, 1997, now Pat. No. 6,010,210.

(51) Int. Cl.[7] ..... B21J 2/175
(52) U.S. Cl. ..... 347/86; 347/85
(58) Field of Search ..... 347/85, 86, 87

(56) References Cited

U.S. PATENT DOCUMENTS

| | | | | |
|---|---|---|---|---|
| 5,040,002 | * | 8/1991 | Pollacek et al. | 347/87 |
| 5,426,459 | | 6/1995 | Kaplinsky | 347/87 |
| 6,010,210 | | 1/2000 | Wilson et al. | 347/85 |

* cited by examiner

*Primary Examiner*—N. Le
*Assistant Examiner*—Anh T. N. Vo

(57) ABSTRACT

An ink container for a supply of liquid ink includes a pressure vessel defining an interior chamber and a collapsible ink reservoir disposed within the interior chamber. The collapsible ink reservoir is adapted to hold the supply of liquid ink therein such that an ink passage communicates with the collapsible ink reservoir and externally of the pressure vessel, and an air passage communicates with the interior chamber of the pressure vessel and externally of the pressure vessel. A flow restrictor communicates with the air passage and, therefore, the interior chamber to restrict flow through the air passage from the interior chamber and permit flow through the air passage into the interior chamber.

32 Claims, 6 Drawing Sheets

INK CONTAINER WITH SECONDARY CONTAINMENT FOR INK SUPPLY

RELATED APPLICATIONS

This application is a continuation of U.S. patent application Ser. No. 09/437,769 titled INK CONTAINER HAVING A MULTIPLE FUNCTION CHASSIS filed Nov. 9, 1999; which is a continuation of U.S. patent application Ser. No. 08/868,927 titled INK CONTAINER HAVING A MULTIPLE FUNCTION CHASSIS filed Jun. 4, 1997, now issued U.S. Pat. No. 6,010,210.

THE FIELD OF THE INVENTION

The present invention relates generally to inkjet printing systems, and ore particularly to an ink container including secondary containment for a supply of liquid ink for an inkjet printing system.

BACKGROUND OF THE INVENTION

A conventional inkjet printing system includes a printhead and an ink supply which supplies liquid ink to the printhead. The printhead ejects ink drops through a plurality of orifices or nozzles and toward a print medium, such as a sheet of paper, so as to print a dot of ink on the print medium. Typically, the orifices are arranged in one or more arrays such that properly sequenced ejection of ink from the orifices causes characters or other images to be printed upon the print medium as the printhead and the print medium are moved relative to each other. In one arrangement, commonly referred to as "on-axis" printing, the ink supply is an integral element with the printhead. In another arrangement, however, commonly referred to as "off-axis" printing, the ink supply is a separate, self-contained ink container connected with the printhead by, for example, a flexible tube. With an off-axis printing system, the mass of the printhead is sharply reduced such that the cost of a printhead drive system and an overall size of a printer can be minimized, and a speed of printing can be increased. In addition, separating the ink supply from the printhead allows the ink to be replaced as it is consumed without requiring replacement of the costly printhead.

A conventional self-contained ink container for an off-axis printing system typically includes a pressure vessel and a collapsible ink reservoir, in the form of a bladder or bag, disposed within the pressure vessel for holding a supply of liquid ink therein. As such, a pressurized air system releases pressurized air into the pressure vessel and around the ink reservoir to collapse the ink reservoir and deliver ink to the printhead. The potential exists, however, for the collapsible ink reservoir to develop a leak. The leak could result, for example, from a pin hole in the collapsible ink reservoir, a rupture of the collapsible ink reservoir, and/or a defective seal of the collapsible ink reservoir. Unfortunately, if a leak does develop, ink can escape from the collapsible ink reservoir. If the ink container is installed with the printing system, ink escaping from the collapsible ink reservoir can enter and contaminate the pressurized air system. If the ink container is separate from the printing system, ink escaping from the collapsible ink reservoir can spill from the pressure vessel.

Accordingly, a need exists for secondary containment of liquid ink disposed within a collapsible ink reservoir of a self-contained ink container. More specifically, a need exists for containing liquid ink which could leak from the collapsible ink reservoir within the ink container and for preventing the liquid ink from spilling outside of the ink container.

SUMMARY OF THE INVENTION

One aspect of the present invention provides an ink container for a supply of liquid ink. The ink container includes a pressure vessel defining an interior chamber and a collapsible reservoir disposed within the interior chamber, wherein the collapsible reservoir is adapted to hold the supply of liquid ink therein. A first flow path communicates with the interior chamber of the pressure vessel and externally of the pressure vessel, and a second flow path communicates with the collapsible reservoir and externally of the pressure vessel. A flow restrictor communicates with the first flow path so as to restrict flow through the first flow path from the interior chamber and permit flow through the first flow path into the interior chamber.

In one embodiment, the first flow path constitutes a gas passage and the second flow path constitutes an ink passage.

In one embodiment, the flow restrictor comprises a one-way valve. In 30 one embodiment, the one-way valve comprises a duckbill check valve.

In one embodiment, the flow restrictor comprises a hydrophobic material, wherein the hydrophobic material restricts ink flow through the first flow path from the interior chamber and permits gas flow through the first flow path into the interior chamber.

In one embodiment, a filter is provided in the first flow path between the flow restrictor and an end of the first flow path communicating externally of the pressure vessel. In one embodiment, a retainer is provided in the first flow path between the filter and the end of the first flow path communicating externally of the pressure vessel, wherein the retainer is configured to retain the filter within the first flow path. In one embodiment, the filter and the retainer are integrally formed.

In one embodiment, a retainer is provided in the first flow path between the flow restrictor and an end of the first flow path communicating externally of the pressure vessel, wherein the retainer is configured to retain the flow restrictor within the first flow path. In one embodiment, the retainer includes an end having a plurality of holes therethrough.

Another aspect of the present invention provides an ink container for a supply of liquid ink. The ink container includes a pressure vessel defining an interior chamber and a collapsible reservoir disposed within the interior chamber, wherein the collapsible reservoir is adapted to hold the supply of liquid ink therein. The ink container also includes an air tower structure external to the pressure vessel and an ink tower structure external to the pressure vessel. As such, an air passage passes through the air tower structure so as to communicate with the interior chamber of the pressure vessel and an ink passage passes through the ink tower structure so as to communicate with the collapsible reservoir. An ink flow restrictor communicates with the air passage so as to restrict ink flow through the air passage from the interior chamber and permit air flow through the air passage into the interior chamber.

Another aspect of the present invention provides an ink container for a supply of liquid ink. The ink container includes a pressure vessel, a collapsible reservoir disposed within an interior chamber of the pressure vessel, and a chassis sealing an opening of a neck portion of the pressure vessel, wherein the collapsible reservoir is adapted to hold the supply of liquid ink therein. The chassis includes an air tower structure external to the pressure vessel and an ink tower structure external to the pressure vessel. As such, an air passage passes through the air tower structure so as to communicate with the interior chamber of the pressure vessel and an ink passage passes through the ink tower structure so as to communicate with the collapsible reservoir. An ink flow restrictor communicates with the air passage so as to restrict ink flow through the air passage from the interior chamber and permit air flow through the air passage into the interior chamber.

Another aspect of the present invention provides an ink container for a supply of liquid ink. The ink container includes a pressure vessel defining an interior chamber and a collapsible reservoir disposed within the interior chamber, wherein the collapsible reservoir is adapted to hold the supply of liquid ink therein. A first flow path communicates with the interior chamber of the pressure vessel and externally of the pressure vessel, and a second flow path communicates with the collapsible reservoir and externally of the pressure vessel. A flow restrictor is disposed within the first flow path so as to restrict flow through the first flow path from the interior chamber and permit flow through the first flow path into the interior chamber, and a filter is disposed within the first flow path between an inlet end of the first flow path and the flow restrictor to prevent debris from clogging the flow restrictor.

Another aspect of the present invention provides a printing system including an ink container defining an interior chamber, a collapsible reservoir disposed within the interior chamber and adapted to hold a supply of liquid ink therein, a pressurized source of gas adapted to occupy a portion of the interior chamber during printing, and a printhead adapted to eject drops of the liquid ink during printing. A first flow path communicates with the interior chamber and externally of the ink container, and a second flow path communicates with the collapsible reservoir and externally of the ink container such that the pressurized source of gas communicates with the first flow path and the printhead communicates with the second flow path. A flow restrictor communicates with the first flow path so as to restrict flow through the first flow path from the interior chamber and permit flow through the first flow path into the interior chamber.

Another aspect of the present invention provides a method of providing liquid ink to a printing system from an ink container including an interior chamber and a collapsible reservoir disposed within the interior chamber, herein the collapsible reservoir is adapted to hold a supply of the liquid ink therein. The method includes the steps of communicating a first flow path with the interior chamber and externally of the ink container, communicating a second flow path with the collapsible reservoir and externally of the ink container, and restricting flow through the first flow path from the interior chamber and permitting flow through the first flow path into the interior chamber.

The present invention provides an ink container which includes secondary containment for liquid ink disposed within a collapsible ink reservoir of the ink container. As such, liquid ink which could leak from the collapsible ink reservoir is contained within the ink container and prevented from spilling outside of the ink container.

DESCRIPTION OF THE PREFERRED EMBODIMENTS

In the following detailed description of the preferred embodiments, reference is made to the accompanying drawings which form a part hereof, and in which is shown by way of illustration specific embodiments in which the invention may be practiced. It is to be understood that other embodiments may be utilized and structural or logical changes may be made without departing from the scope of the present invention. The following detailed description, therefore, is not to be taken in a limiting sense, and the scope of the present invention is defined by the appended claims.

Figure 1:
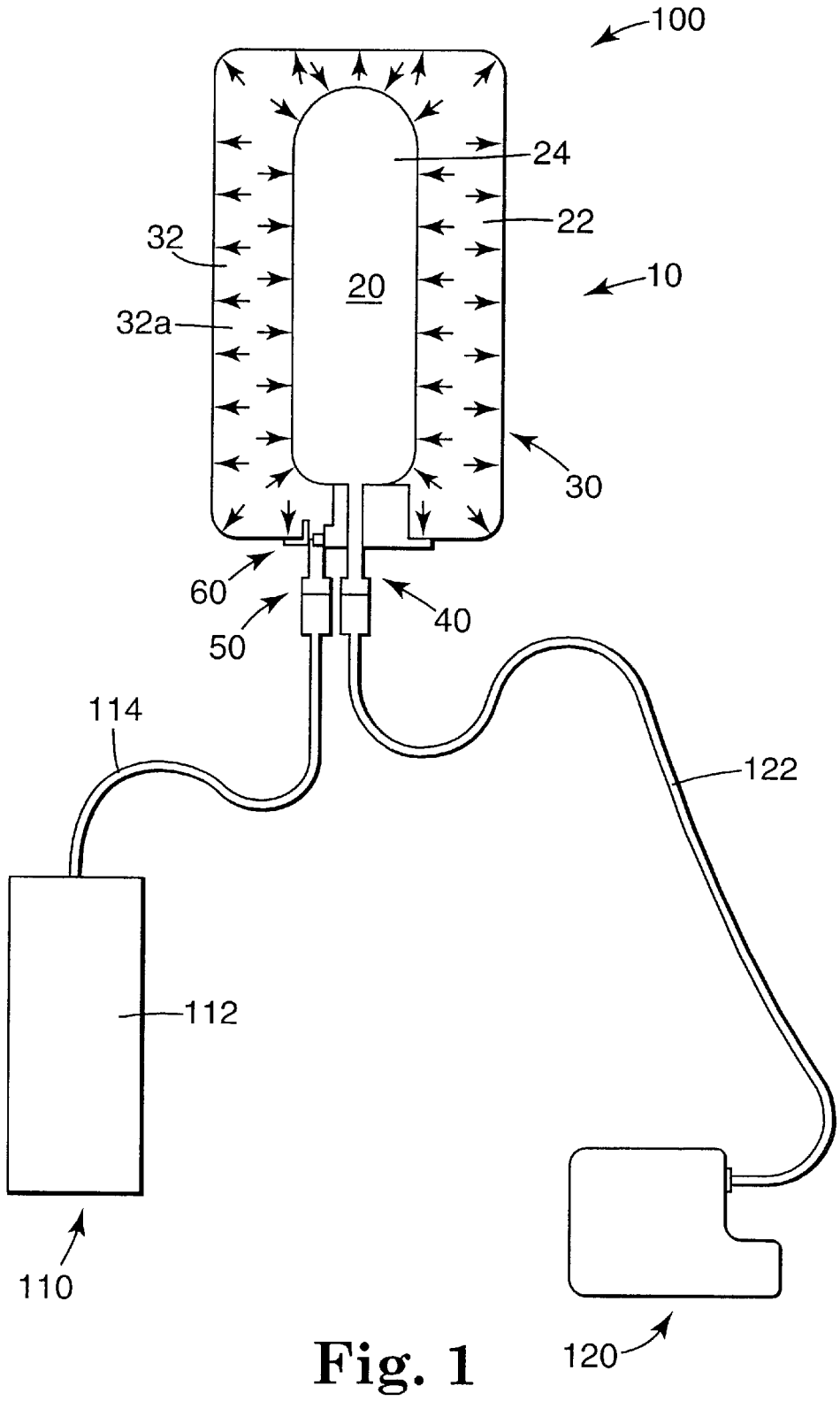
FIG. 1 is a schematic illustration of a portion of an inkjet printing system including an ink container according to the present invention.

FIG. 1 illustrates one embodiment of a portion of an inkjet printing system 100 according to the present invention. Inkjet printing system 100 is an off-axis printing system and includes an ink container 10, a pressurized source 110, and a printhead 120. Ink container 10 includes a collapsible ink reservoir and a pressure vessel 30 surrounding collapsible ink reservoir 20 such that a pressure chamber 22 is defined between pressure vessel 30 and collapsible ink reservoir 20. As such, pressurized source 110 communicates with pressure chamber 22 and printhead 120 communicates with collapsible ink reservoir 20. Thus, pressurized air released into pressure chamber 22 pressurizes collapsible ink reservoir 20 and delivers pressurized ink to printhead 120.

Pressurized source 110 includes a pressurized source of gas. In one embodiment, the gas is air delivered by a pump 112. As such, pump 112 generates and delivers pressurized air to pressure chamber 22 via a pressure supply line 114. While the following description only refers to using pressurized air, it is understood that use of other gases, or combinations of gases, is within the scope of the present invention.

Printhead 120 has a plurality of ink orifices (not shown) formed therein in a manner well known to those skilled in the art. Example embodiments of printhead 120 include a thermal printhead, a piezoelectric printhead, or any other type of inkjet printhead known in the art. If printhead 120 is, for example, a thermal printhead, printhead 120 typically includes a substrate layer (not shown) having a plurality of resistors (not shown) which are operatively associated with the ink orifices. Upon energization of the resistors, in response to command signals delivered by a controller (not shown) to printhead 120, drops of ink are ejected through the ink orifices toward a print medium (not shown). In one embodiment, printhead 120 receives ink from ink container 10 via an ink supply line 122.

Figure 2:
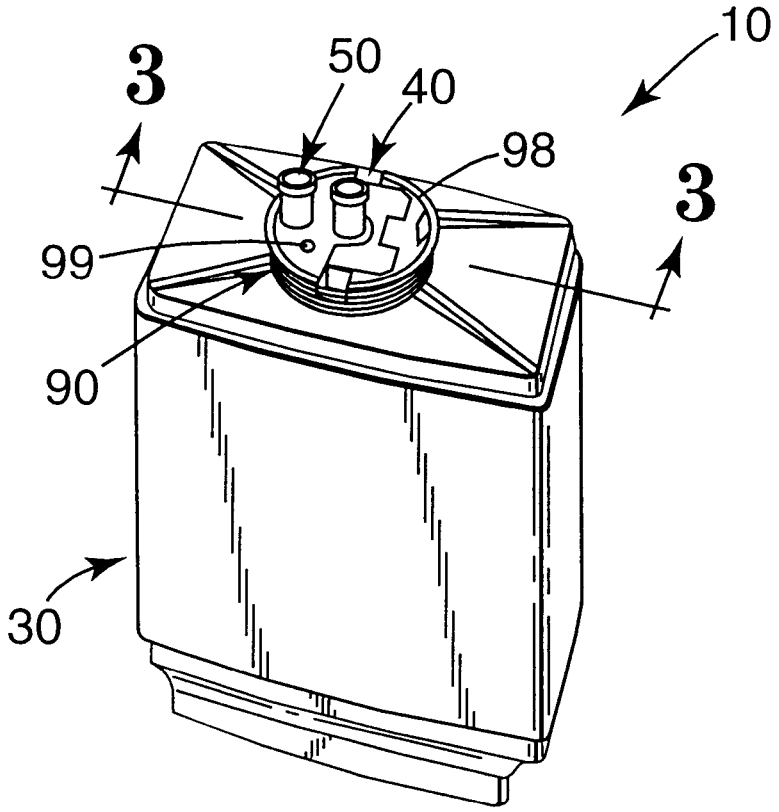
FIG. 2 is a top perspective view of an ink container according to the present invention.

As illustrated in FIGS. 1 and 2, ink container 10 includes collapsible ink reservoir 20, pressure vessel 30, an ink tower structure 40, an air tower structure 50, and an ink flow restrictor 60. Pressure vessel 30 defines an interior chamber 32 in which collapsible ink reservoir 20 is disposed. Thus, an unoccupied portion 32a of interior chamber 32 is formed between pressure vessel 30 and collapsible ink reservoir 20. As such, unoccupied portion 32*a* defines pressure chamber 22 surrounding collapsible ink reservoir 20. In one embodiment, collapsible ink reservoir 20 is formed by a flaccid bag 24. When full of ink, flaccid bag 24 substantially occupies interior chamber 32 of pressure vessel 30. While pressure vessel 30 is illustrated as being generally rectangular in shape, it is within the scope of the present invention for pressure vessel 30 to be of any size, shape, and/or volume.

Figure 3:
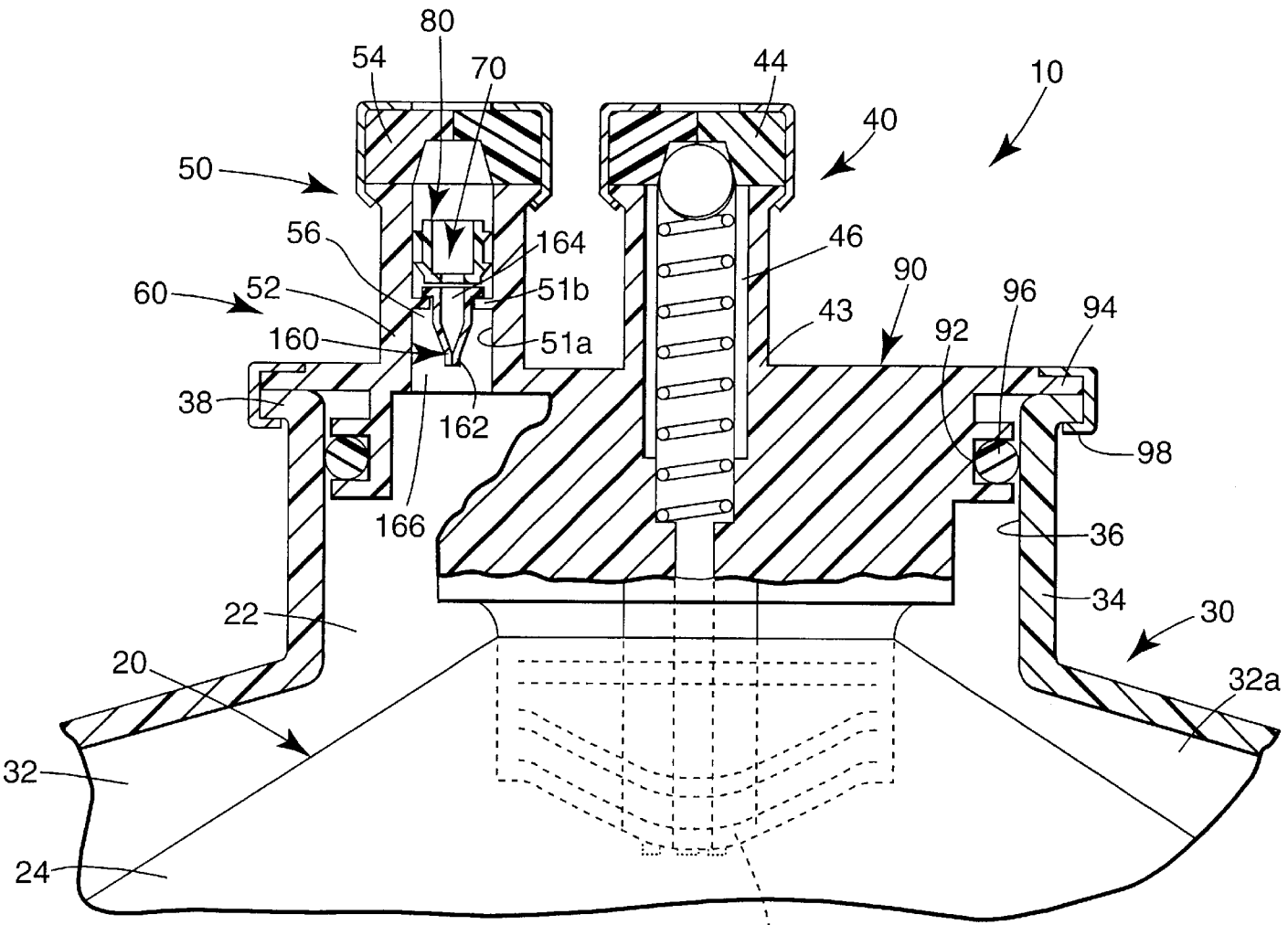
FIG. 3 is a cross-sectional view taken along line 3—3 of FIG. 2 illustrating portions of the ink container including one embodiment of an ink flow restrictor in a closed state.

As illustrated in FIGS. 2 and 3, ink tower structure 40 has a first end 42 and a second end 44 with an intermediate portion 43 therebetween. First end 42 extends into pressure vessel 30 and is sealed within collapsible ink reservoir 20 as described in U.S. Pat. No. 6,010,210, the disclosure of which is incorporated herein by reference. Intermediate portion 43 is coupled with pressure vessel 30 and second end 44 provides an ink supply connection configured for connection with ink supply line 122 (FIG. 1). As such, an ink flow passage 46 extends through ink tower structure 40. Thus, ink flow passage 46 communicates with collapsible ink reservoir 20 and communicates externally of pressure vessel 30 such that second end 44 constitutes an outlet end of ink tower structure 40.

As illustrated in FIGS. 2 and 3, air tower structure 50 has a first end 52 and a second end 54. First end 52 is coupled with pressure vessel 30 and second end 54 provides an air supply connection configured for connection with pressure supply line 114 (FIG. 1). As such, an air flow passage 56 extends through air tower structure 50. Thus, air flow passage 56 communicates with unoccupied portion 32*a* of interior chamber 32 and communicates externally of pressure vessel 30 such that second end 54 constitutes an inlet end of air tower structure 50.

Figure 4:
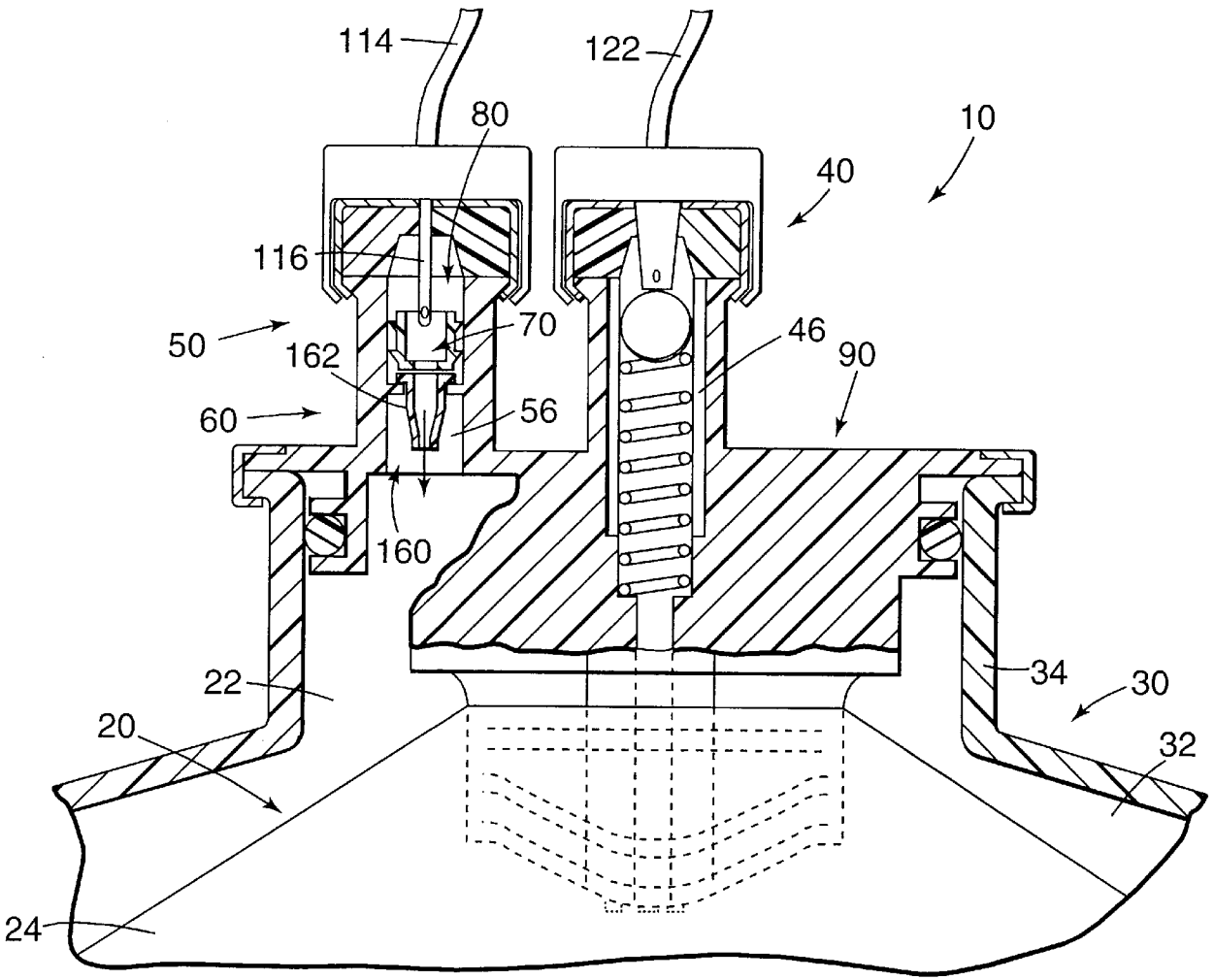
FIG. 4 is a cross-sectional view similar to FIG. 3 illustrating the ink flow restrictor in an open state.

In one embodiment, ink tower structure 40 and air tower structure 50 are each external to pressure vessel 30. As illustrated in FIG. 4, ink supply line 122 communicates with ink tower structure 40 and pressure supply line 114 communicates with air tower structure 50. Thus, ink supply line 122 communicates with ink flow passage 46 and pressure supply line 114 communicates with air flow passage 56. As such, pressurized air is introduced into interior chamber 32 through pressure supply line 114, air flow passage 56, and ink flow restrictor 60. By introducing pressurized air into interior chamber 32, and more specifically, unoccupied portion 32a, pressure within interior chamber 32 increases. Due to the increased pressure, a quantity of liquid ink is forced through ink flow passage 46 during printing. As such, liquid ink flows through ink tower structure 40 and ink supply line 122 to printhead 120.

As illustrated in FIGS. 3–6, ink flow restrictor 60 communicates with air flow passage 56 to restrict ink flow through air flow passage 56 from interior chamber 32. Ink flow restrictor 60, however, permits air flow through air flow passage 56 into interior chamber 32. Should ink leak from collapsible ink reservoir 20, ink flow restrictor 60 prevents ink from entering pressure supply line 114 and, subsequently, pressurized source 110 when ink container 10 is installed with printing system 100. Ink flow restrictor 60, therefore, prevents ink from contaminating pressure supply line 114 and/or pressurized source 110. In addition, ink flow restrictor 60 prevents ink from spilling from pressure vessel 30 when ink container 10 is not connected with printing system 100. Thus, ink low restrictor 60 restricts flow through air flow passage 56 from interior chamber 32 and permits flow through air flow passage 56 into interior chamber 32.

Figure 5:
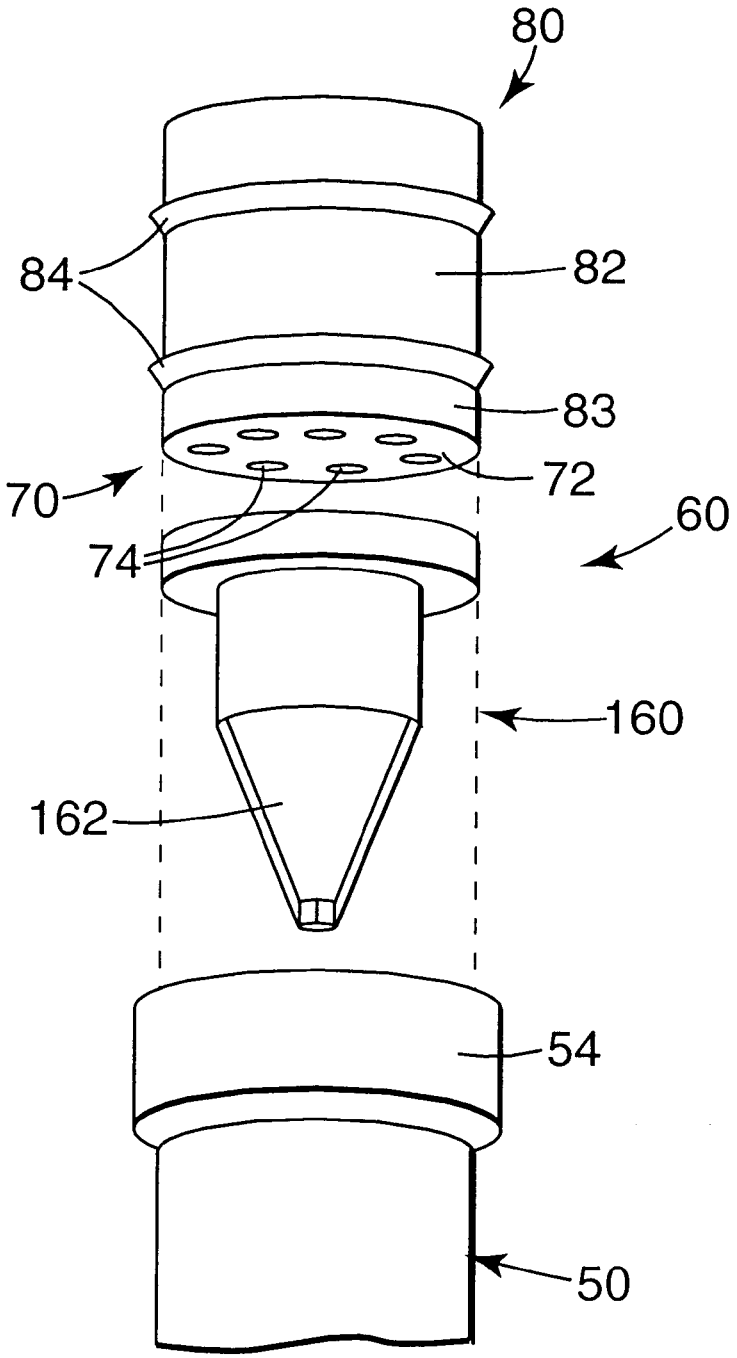
FIG. 5 is an exploded, bottom perspective view of a portion of the ink container of FIG. 2.

FIGS. 3–5 illustrate one embodiment of ink flow restrictor 60. Ink flow restrictor 160 is a one-way valve 162 provided within air flow passage 56. One-way valve 162 communicates externally of air tower structure 50 on an input side 164 and communicates with interior chamber 32 on an output side 166. One-way valve 162 permits substantially no flow in an upstream direction from interior chamber 32 and permits flow only in a downstream direction into interior chamber 32.

In one embodiment, one-way valve 162 is made of a flexible material, for example, rubber, and is commonly referred to as a duckbill check valve. The duckbill check valve includes converging lips which are "normally closed" at zero differential pressure. As such, the duckbill check valve allows free flow with positive differential pressure and prevents backflow with negative differential pressure. An example of one-way valve 162 is a VA3120 valve manufactured by Vemay Laboratories. In one embodiment, air tower structure 50 has an interior surface 51*a* and includes a circumferential flange 51*b* extending radially inward therefrom. As such, circumferential flange 51*b* constitutes a retaining lip for one-way valve 162.

One-way valve 162 has a closed state, as illustrated in FIG. 3, and an open state, as illustrated in FIG. 4, depending on an operational state of ink jet printing system 100. When ink container 10 is connected with pressurized source 110 and printhead 120, pressure supply line 114 is connected with air tower structure 50 and ink supply line 122 is connected with ink tower structure 40, as illustrated in FIG. 4. When pressure supply line 114 is connected with air tower structure 50, a needle 116, provided at an end of pressure supply line 114, is inserted into air flow passage 56. As such, pressurized air is released into air flow passage 56 through needle 116 from pressure supply line 114. When pressurized air is released into air flow passage 56, one-way valve 162 opens, as illustrated in FIG. 4, to release air into pressure chamber 22 and pressurize collapsible ink reservoir 20. When pressure within pressure chamber 22 reaches the pressure of pressure supply line 114, one-way valve 162 closes.

In one embodiment, as illustrated in FIGS. 3–5, a filter 70 is provided in-line in air flow passage 56 between ink flow restrictor 60 and second end 54 of air tower structure 50. In addition, a retainer 80 is provided in-line in air flow passage 56 between filter 70 and second end 54 of air tower structure 50. Filter 70 is a disc 72 which has a plurality of holes 74 formed therein and retainer 80 is a cylindrical sleeve 82. Cylindrical sleeve 82 has an outer peripheral surface 83 and includes a retaining edge 84 protruding from outer peripheral surface 83. As such, retaining edge 84 engages interior surface 511*a* of air tower structure 50 when retainer 80 is disposed within air passage 56. Thus, retainer 80 retains filter 70 and ink flow restrictor 60 within air flow passage 56 while filter 70 prevents debris from clogging ink flow restrictor 60. In one embodiment, filter 70 and retainer 80 are integrally formed such that disc 72 is formed at one end of cylindrical sleeve 82. It is, however, within the scope of the present invention for filter 70 and retainer 80 to be formed separately.

Figure 6:
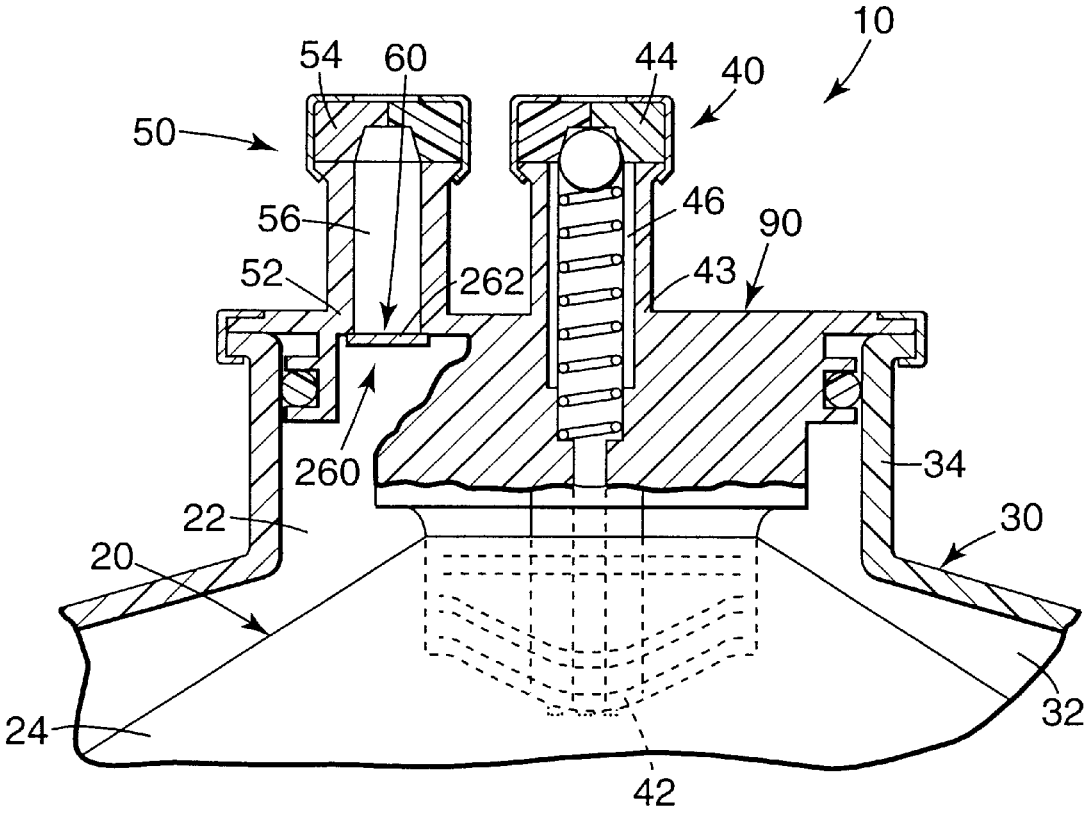
FIG. 6 is cross-sectional view similar to FIG. 3 illustrating portions of the ink container including another embodiment of an ink flow restrictor.

FIG. 6 illustrates another embodiment of ink flow restrictor 60. In one embodiment, ink flow restrictor 260 is provided at first end 52 of air tower structure 50. Ink flow restrictor 260, therefore, communicates with interior chamber 32 on one side and air flow passage 56 on an opposite side. In addition, ink flow restrictor 260 is a hydrophobic material, namely a material which lacks an affinity for water. An example of such material is GORE-TEX®, manufactured by W. L. Gore and Associates. Thus, ink does not pass through ink flow restrictor 260 and enter air flow passage 56. Air, however, freely passes through ink flow restrictor 260.

In one embodiment, as illustrated in FIGS. 2 and 3, pressure vessel 30 includes a neck portion 34 having an opening 36 extending therethrough and ink container 10 includes a chassis 90 with which ink tower structure 40 and air tower structure 50 are formed and to which collapsible ink reservoir 20 is connected for communication with ink flow passage 46 as described in the aforementioned U.S. Pat. No. 6,010,210. As such, opening 36 communicates with interior chamber 32 and communicates externally of pressure vessel 30. Chassis 90, however, seals opening 36 of neck portion 34.

In one embodiment, ink tower structure 40 and air tower structure 50 each extend external to pressure vessel 30 in a first direction substantially perpendicular to chassis 90. Ink tower structure 40 and air tower structure 50, therefore, each protrude beyond neck portion 34 of pressure vessel 30 when chassis 90 seals opening 36. While ink tower structure 40 and air tower structure 50 are illustrated as being formed integrally with chassis 90, it is within the scope of the present invention for ink tower structure 40 and/or air tower structure 50 to be formed separately from and then secured to chassis 90.

In one embodiment, chassis 90 fits within neck portion 34 and is secured to pressure vessel 30 so as to seal opening 36. As such, chassis 90 has a circumferential groove 92 defined in an outer periphery thereof and includes a circumferential flange 94 extending radially outward therefrom. In addition, neck portion 34 includes a circumferential flange 38 extending radially outward therefrom. Thus, circumferential flange 94 of chassis 90 mates with circumferential flange 38 of pressure vessel 30 when chassis 90 is inserted into opening 36 of neck portion 34. An o-ring 96 is disposed within circumferential groove 92 of chassis 90 to provide a fluid-tight seal with neck portion 34 and a crimp ring 98 secures circumferential flange 94 of chassis 90 to circumferential flange 38 of pressure vessel 30. Furthermore, a vent 99 is provided in chassis 90 to slowly vent pressurized air from pressure vessel 30 when ink container 10 is depressurized.

In use, ink container 10 is connected with pressurized source 110 and printhead 120 by connecting pressure supply line 114 with air tower structure 50 and ink supply line 122 with ink tower structure 40, as illustrated in FIGS. 1 and 4. As such, pressurized air is released into air flow passage 56 and pressure chamber 22 through pressure supply line 114 so as to pressurize and collapse collapsible ink reservoir 20. Thus, ink is forced through ink flow passage 46 and ink supply line 122 to printhead 120. Should ink leak from collapsible ink reservoir 20 when ink container 10 is installed with printing system 100, ink flow restrictor 60 prevents ink from passing through air flow passage 56 and entering pressure supply line 114 and, subsequently, pressurized source 110. Ink flow restrictor 60, therefore, prevents ink from contaminating pressure supply line 114 and/or pressurized source 110. Furthermore, when ink container 10 is not connected with printing system 100, ink flow restrictor 60 prevents ink from spilling from pressure vessel 30 if a leak develops with collapsible ink reservoir 20.

By providing secondary containment for liquid ink disposed within collapsible ink reservoir 20, ink container 10 prevents ink which could leak from collapsible ink reservoir 20 from contaminating pressure supply line 114 and/or pressurized source 110 when ink container 10 is installed with printing system 100. In addition, ink container 10 prevents ink which could leak from collapsible ink reservoir 20 from spilling from pressure vessel 30 when ink container 10 is not connected with printing system 100.

Although specific embodiments have been illustrated and described herein for purposes of description of the preferred embodiment, it will be appreciated by those of ordinary skill in the art that a wide variety of alternate and/or equivalent implementations calculated to achieve the same purposes may be substituted for the specific embodiments shown and described without departing from the scope of the present invention. Those with skill in the chemical, mechanical, electromechanical, electrical, and computer arts will readily appreciate that the present invention may be implemented in a very wide variety of embodiments. This application is intended to cover any adaptations or variations of the preferred embodiments discussed herein. Therefore, it is manifestly intended that this invention be limited only by the claims and the equivalents thereof

What is claimed is:

1. An ink container for a supply of liquid ink, the ink container comprising:

a pressure vessel defining an interior chamber;

a collapsible reservoir disposed within the interior chamber of the pressure vessel, the collapsible reservoir adapted to hold the supply of liquid ink therein;

a first flow path communicating with the interior chamber of the pressure vessel and communicating externally of the pressure vessel;

a second flow path communicating with the collapsible reservoir and communicating externally of the pressure vessel; and a flow restrictor communicating with the first flow path, wherein the flow restrictor restricts flow through the first flow path from the interior chamber and permits flow through the first flow path into the interior chamber.

2. The ink container of claim 1, wherein the first flow path constitutes a gas passage and the second flow path constitutes an ink passage, and wherein the flow restrictor restricts ink flow through the first flow path from the interior chamber.

3. The ink container of claim 2, wherein the flow restrictor comprises a one-way valve and permits gas flow through the first flow path into the interior chamber.

4. The ink container of claim 3, wherein the one-way valve comprises a duckbill check valve.

5. The ink container of claim 1, wherein the flow restrictor comprises a hydrophobic material, wherein the hydrophobic material restricts ink flow through the first flow path from the interior chamber and permits gas flow through the first flow path into the interior chamber.

6. The ink container of claim 1, further comprising:

a filter provided in the first flow path between the flow restrictor and an end of the first flow path communicating externally of the pressure vessel.

7. The ink container of claim 6, further comprising:

a retainer provided in the first flow path between the filter and the end of the first flow path communicating externally of the pressure vessel, the retainer configured to retain the filter within the first flow path.

8. The ink container of claim 7, wherein the filter and the retainer are integrally formed.

9. The ink container of claim 1, further comprising:

a retainer provided in the first flow path between the flow restrictor and an end of the first flow path communicating externally of the pressure vessel, the retainer configured to retain the flow restrictor within the first flow path.

10. The ink container of claim 9, wherein the retainer includes an end having a plurality of holes therethrough.

11. An ink container for a supply of liquid ink, the ink container comprising:

a pressure vessel defining an interior chamber;

a collapsible reservoir disposed within the interior chamber of the pressure vessel, the collapsible reservoir adapted to hold the supply of liquid ink therein;

an air tower structure external to the pressure vessel;

an ink tower structure external to the pressure vessel;

an air passage passing through the air tower structure and communicating with the interior chamber of the pressure vessel;

an ink passage passing through the ink tower structure and communicating with the collapsible reservoir; and an ink flow restrictor communicating with the air passage, wherein the ink flow restictor restricts ink flow through the air passage from the interior chamber and permits air flow through the air passage into the interior chamber.

12. The ink container of claim 11, wherein the ink flow restrictor comprises a one-way valve.

13. The ink container of claim 12, wherein the one-way valve comprises a duckbill check valve.

14. The ink container of claim 11, wherein the ink flow restrictor comprises a hydrophobic material.

15. The ink container of claim 11, further comprising:

a filter provided in the air passage between the ink flow restrictor and an end of the air tower structure external to the pressure vessel.

16. The ink container of claim 15, further comprising:

a retainer provided in the air passage between the filter and the end of the air tower structure external to the pressure vessel, the retainer configured to retain the filter within the air passage.

17. The ink container of claim 16, wherein the filter and the retainer are integrally formed.

18. The ink container of claim 11, further comprising:

a retainer provided in the air passage between the ink flow restrictor and an end of the air tower structure external to the pressure vessel, the retainer configured to retain the ink flow restrictor within the air passage.

19. The ink container of claim 18, wherein the retainer includes an end having a plurality of holes therethrough.

20. The ink container of claim 19, wherein the retainer includes at least one retaining edge protruding from an outer peripheral surface thereof, the retaining edge engaging an interior surface of the air tower structure.

21. An ink container for a supply of liquid ink, the ink container comprising:

a pressure vessel defining an interior chamber and including a neck portion having an opening defined therein;

a collapsible reservoir disposed within the interior chamber of the pressure vessel, the collapsible reservoir adapted to hold the supply of liquid ink therein; and a chassis sealing the opening of the neck portion, the chassis including:

an air tower structure external to the pressure vessel, an ink tower structure external to the pressure vessel, an air passage passing through the air tower structure and communicating with the interior chamber of the pressure vessel, an ink passage passing through the ink tower structure and communicating with the collapsible reservoir, and an ink flow restrictor communicating with the air passage, wherein the ink flow restrictor restricts ink flow through the air passage from the interior chamber and permits air flow through the air passage into the interior chamber.

22. An ink container for a supply of liquid ink, the ink container comprising:

a pressure vessel defining an interior chamber;

a collapsible reservoir disposed within the interior chamber of the pressure vessel, the collapsible reservoir adapted to hold the supply of liquid ink therein;

a first flow path communicating with the interior chamber of the pressure vessel, the first flow path having an inlet end communicating externally of the pressure vessel;

a second flow path communicating with the collapsible reservoir, the second flow path having an outlet end communicating externally of the pressure vessel;

a flow restrictor disposed within the first flow path, wherein the flow restrictor restricts flow through the first flow path from the interior chamber and permits flow through the first flow path into the interior chamber; and a filter disposed within the first flow path between the inlet end of the first flow path and the flow restrictor.

23. The ink container of claim 22, wherein the first flow path constitutes a gas passage and the second flow path constitutes an ink passage, and wherein the flow restrictor restricts ink flow through the first flow path from the interior chamber.

24. The ink container of claim 23, wherein the flow restrictor comprises a one-way valve and permits gas flow through the first flow path into the interior chamber.

25. The ink container of claim 24, wherein the one-way valve comprises a duckbill check valve.

26. The ink container of claim 22, wherein the filter comprises a circular disc having a plurality of holes therethrough.

27. The ink container of claim 22, further comprising:

a retainer provided in the first flow path between the inlet end of the first flow path and the filter.

28. The ink container of claim 27, wherein the retainer comprises a cylindrical sleeve.

29. A printing system, comprising:

an ink container defining an interior chamber;

a collapsible reservoir disposed within the interior chamber and adapted to hold a supply of liquid ink therein;

a first flow path communicating with the interior chamber and communicating externally of the ink container;

a second flow path communicating with the collapsible reservoir and communicating externally of the ink container;

a flow restrictor communicating with the first flow path, wherein the flow restrictor restricts flow through the first flow path from the interior chamber and permits flow through the first flow path into the interior chamber;

a pressurized source of gas communicating with the first flow path, the pressurized source of gas adapted to occupy a portion of the interior chamber during printing; and a printhead communicating with the second flow path, the printhead adapted to eject drops of the liquid ink during printing.

30. The printing system of claim 29, wherein the flow restrictor restricts ink flow through the first flow path from the interior chamber and permits gas flow through the first flow path into the interior chamber.

31. A method of providing liquid ink to a printing system from an ink container including an interior chamber and a collapsible reservoir disposed within the interior chamber, the collapsible reservoir adapted to hold a supply of the liquid ink therein, the method comprising the steps of:

communicating a first flow path with the interior chamber and communicating the first flow path externally of the ink container; communicating a second flow path with the collapsible reservoir and communicating the second flow path externally of the ink container; and restricting flow through the first flow path from the interior chamber and permitting flow through the first flow path into the interior chamber.

32. The method of claim 31, wherein the step of restricting flow through the first flow path from the interior chamber and permitting flow through the first flow path into the interior chamber includes restricting ink flow through the first flow path from the interior chamber and permitting gas flow through the first flow path into the interior chamber.

* * * * *